US007201136B2

(12) United States Patent
McKay et al.

(10) Patent No.: US 7,201,136 B2
(45) Date of Patent: Apr. 10, 2007

(54) DIRECT INJECTION OF FUELS IN INTERNAL COMBUSTION ENGINES

(75) Inventors: Michael Leonard McKay, Perth (AU); David John Longman, Perth (AU); James Allen Kimmel, Williamsburg, VA (US)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 600 days.

(21) Appl. No.: 10/124,731

(22) Filed: Apr. 18, 2002

(65) Prior Publication Data

US 2005/0045146 A1 Mar. 3, 2005

Related U.S. Application Data

(63) Continuation-in-part of application No. PCT/AU00/01267, filed on Oct. 18, 2000.

(30) Foreign Application Priority Data

Oct. 18, 1999 (AU) ..... PQ 3501
Oct. 18, 1999 (AU) ..... PQ 3502
Oct. 22, 1999 (AU) ..... PQ 3607

(51) Int. Cl.
*F02M 57/06* (2006.01)

(52) U.S. Cl. ..... 123/297; 239/585.1

(58) Field of Classification Search ..... 123/297; 239/533.12, 585.1

See application file for complete search history.

(56) References Cited

U.S. PATENT DOCUMENTS 4,967,708 A * 11/1990 Linder et al. ..... 123/297
5,497,744 A * 3/1996 Nagaosa et al. ..... 123/297
5,518,185 A * 5/1996 Takeda et al. ..... 239/585.1
5,551,638 A * 9/1996 Caley ..... 239/533.12
5,692,723 A * 12/1997 Baxter et al. ..... 239/585.1
5,769,391 A * 6/1998 Noller et al. ..... 251/129.21
5,983,855 A * 11/1999 Benedikt et al. ..... 123/297
5,996,910 A * 12/1999 Takeda et al. ..... 239/585.1
6,003,790 A * 12/1999 Fly ..... 239/533.9
6,012,655 A * 1/2000 Maier ..... 239/585.1
6,047,907 A * 4/2000 Hornby ..... 239/585.1

(Continued)

FOREIGN PATENT DOCUMENTS

DE 197 36 684 A1 2/1999

(Continued)

*Primary Examiner*—T. M. Argenbright
(74) *Attorney, Agent, or Firm*—Rothwell, Figg, Ernst & Manbeck

(57) ABSTRACT

A fuel delivery injector for an internal combustion engine is provided. A fuel injector forms part of a device which provides a combined injection and ignition. The fuel delivery injector comprises first and second portions adapted to be detachably connected together. The first portion incorporates a valve structure having a valve member movable with respect to a valve seat for opening and closing a delivery port, and an actuating member operatively connected to the valve member. An actuator is provided in the second portion. When the first and second portions are connected together, the actuator is operably associated with the actuating member to provide an actuating assembly. Typically, the actuating assembly comprises an electromagnetic device in which the actuating member comprises a solenoid armature and the actuator comprises a solenoid coil, whereby connection of the first and second portions together completes assembly of the electromagnetic device.

55 Claims, 8 Drawing Sheets

U.S. PATENT DOCUMENTS

| | | | | |
|---|---|---|---|---|
| 6,182,912 | B1 | 2/2001 | Müller et al. | |
| 6,264,112 | B1 * | 6/2001 | Lanschool et al. | 239/585.1 |
| 6,364,220 | B2 * | 4/2002 | Willke et al. | 239/585.1 |
| 6,405,427 | B2 * | 6/2002 | Kummer | 239/585.1 |

FOREIGN PATENT DOCUMENTS

| | | | |
|---|---|---|---|
| EP | 0 632 198 | A1 | 1/1995 |
| GB | 1002694 | A | 8/1965 |

* cited by examiner

DIRECT INJECTION OF FUELS IN INTERNAL COMBUSTION ENGINES

CROSS-REFERENCE TO RELATED APPLICATION

This application is a Continuation-In-Part of PCT/AU00/01267, filed Oct. 18, 2000, the entire specification claims and drawings of which are incorporated herewith by reference.

TECHNICAL FIELD

This invention relates to the injection of fuels in internal combustion engines. More particularly, the invention relates to apparatus for direct injection of fuels into spark-ignition internal combustion engines. The invention also relates to a combined fuel injection and ignition means for spark-ignition internal combustion engines.

BACKGROUND OF THE INVENTION

For a spark-ignition internal combustion engine, it is customary for fuel to be injected by way of an injector constructed as an assembly of component parts, with the assembly fitted to the engine as a unit. The injector is then connected to fuel and electrical power supplies. Where fuel is delivered by the injector into a combustion chamber entrained in a gas such as air (such as, for example, by way of the arrangement disclosed in the Applicant's U.S. Pat. No. 4,693,224, the contents of which are included herein by reference), the injector is also typically connected to an air supply such as a gas compressor. Typically, the injector in such a dual fluid injection system is adapted to be coupled to the various supplies through a fuel and air supply rail (such as, for example, as is disclosed in the Applicant's U.S. Pat. No. RE 36768, the contents of which are also included herein by reference) arranged to deliver services to all of the injectors fitted to the engine. The injector is provided with appropriate connectors for connection to the fuel and air supply rail. The injector is also provided with one or more electrical terminals for connection to electrical control circuitry as necessary.

Typically, the injector has a delivery end section with a delivery port through which fuel is injected into the combustion chamber. The delivery end section generally includes a valve seat, and a valve member movable into and out of sealing engagement with the valve seat for selectively opening and closing the delivery port. The valve member forms part of a valve having a valve stem, one end of which supports the valve member. An electromagnetic system is typically utilised for operation of the valve to selectively open and close the delivery port. The electromagnetic system includes a solenoid coil located in the body of the injector about the valve stem, and a solenoid armature attached to the valve stem. Energisation of the solenoid coil typically induces movement of the armature to cause the valve member to move out of engagement with the valve seat against the influence of a spring which normally retains the valve in the sealing or closed condition.

In a dual fluid fuel system, because the injector needs to be coupled to the air and fuel supply rail and also to the electrical control circuitry, it is necessary to ensure that the connectors and the electrical terminals on the injector are correctly aligned in relation to counterpart components with which they are to mate when the injector is in the installed condition. This requires careful installation of the injector in the engine.

It is also necessary to calibrate the valve with respect to the electromagnetic means so that the stroke length of the valve induced by energisation of the electromagnetic means is properly related to the extent to which the valve is required to open. Because of the manner in which the valve is constructed and assembled, typically, calibration of the valve can only be performed after it has been fully assembled. This can often present some difficulties in terms of the accuracy, stability and reliability of calibration.

The difficulties referred to above are likely to increase significantly in circumstances where the fuel injector is combined in a single unit with an ignition means. In such circumstances, it is also necessary to provide a high tension current path for ignition purposes, and there are also associated insulation considerations. This generally requires that the injector be constructed from various materials, some having electrically conductive properties and others having electrically insulating properties. It is the presence of these various materials that often creates significant difficulties in relation to calibration.

Examples of arrangements involving combined fuel injection and ignition means are disclosed in U.S. Pat. No. 4,967,708 (Linder et al), EP 0 632 198 (Suzuki), U.S. Pat. No. 5,497,744 (Nagaosa et al), and U.S. Pat. No. 5,730,100 (Bergsten). Each of the combined fuel injection and ignition means disclosed therein are one-piece assemblies which can be cumbersome to install and maintain and which generally have alignment difficulties as discussed above when in the installed condition. Furthermore, such arrangements typically involve complicated connections for high voltage current paths which exist therein, and so are fraught with safety problems.

It is against this background, and the problems and difficulties associated therewith, that the present invention has been developed.

DISCLOSURE OF THE INVENTION

The present invention provides a fuel delivery injector for an internal combustion engine, the fuel delivery injector comprising a first portion and a second portion adapted to be detachably connected to the first portion, the first portion having a delivery port defined between a valve seat and a valve member movable with respect to the valve seat for opening and closing the delivery port, an actuating member provided in the first portion and operatively connected to the valve member, and an actuating means provided in the second portion whereby when the first and second portions are connected together the actuating means is operably associated with the actuating member to provide an actuating assembly.

Preferably, the engine is a spark-ignition internal combustion engine.

Conveniently, the delivery injector may be a single fluid fuel delivery injector or a dual fluid fuel delivery injector wherein both air and fuel are delivered by the injector to the engine.

Preferably, the actuating member may be a solenoid armature and the actuating means may be a solenoid coil. With this arrangement, the actuating assembly comprises an electromagnetic means, wherein connection of the first and second portions together completes assembly of the electromagnetic means comprising the solenoid coil and the solenoid armature. It is however to be understood that the actuating member and the actuating means may together provide any other suitable type of assembly such as, for example, a piezo-electric actuating assembly.

Conveniently, the first portion is arranged to engage with an appropriate part of the engine such that the delivery injector is able to directly deliver fuel into a combustion chamber of the engine. Preferably, connection of the first and second portions together also establishes a flow path through the injector along which a fuel charge can be delivered to the combustion chamber. The fuel flow path conveniently comprises a first flow path section in the first portion and a second flow path section in the second portion, the two flow path sections communicating to provide the fuel flow path when the first and second portions are connected together.

Preferably, the solenoid coil is disposed concentrically about the solenoid armature when the first and second portions are connected together.

The injector may form part of a combined injection and ignition means, in which case connection of the first and second portions together may also establish a high voltage current path between the two portions to form part of an ignition circuit.

The ignition circuit may include a primary electrode and a secondary electrode separated by a spark gap, wherein one of the electrodes is arranged to form part of the delivery injector. Preferably, the primary electrode is mounted on the first portion so as to be located within the combustion chamber when the delivery injector is fitted to the engine. Conveniently, the primary electrode is mounted on or configured as part of the valve member. Preferably, the secondary electrode is also dependent from the first portion of the injector. However, it is to be appreciated that the secondary electrode may be mounted on another suitable component of the engine such as a piston or the cylinder head thereof.

Conveniently, the valve member includes a projection and the primary electrode is provided by the projection. Preferably, the projection depends downwardly of the valve member and is arranged to provide certain spray guidance benefits to the fuel issuing from the delivery port. Such a projection is described, for example, in the Applicant's U.S. Pat. No. 5,551,638, the contents of which are included herein by reference. Conveniently, the valve is of the outwardly opening type. In an alternative arrangement, where a separate sparking means is used to effect the ignition event, the projection may be arranged to form one of the electrodes of the sparking means. In such a case, the projection may be configured to form part of the valve member or delivery injector, or alternatively, the projection may be formed as part of the sparking means itself.

Alternatively, and whether the injector forms part of a combined injection and ignition means or not, the ignition circuit may be arranged such that a spark is jumped directly to the projection or the valve member which may serve as an electrode of such an alternative arrangement.

The valve may further comprise a valve stem at one end of which the valve member is located, the actuating member being operably connected to the valve member by way of the valve stem. In this regard, the actuating member or armature may be attached to the end of the valve stem opposite to the valve member.

The valve stem may be of hollow construction to provide a central bore which forms part of the first flow path section. Openings may be provided in the wall of the valve stem to permit a fuel charge to pass from the central bore to an outer region from where it can be delivered into the combustion chamber upon opening of the delivery port. Such a hollow stem injector is described, for example, in the Applicant's U.S. Pat. No. RE 36768. The valve stem is guided for axial movement in a valve housing of the injector as it moves the valve member into and out of engagement with the valve seal.

In an alternative arrangement, the armature of the electromagnetic means may be provided as a permanent magnet. In such an arrangement, the polarity of an outer magnetic circuit could be reversed by an associated energizing arrangement such that the armature may be controlled by magnetic force to both open and close the valve.

The valve may be biased into a normal condition in which the valve member is in sealing engagement with the valve seat. This may be achieved by way of a valve control spring acting on the valve member. The valve may be of either the outwardly or inwardly opening type wherein actuation of the electromagnetic means serves to displace the valve member away from the valve seat against the action of the valve control spring.

The valve housing within which the valve is supported may be accommodated in an insulator such as, for example, a ceramic insulator. Conveniently, the valve housing is of tubular construction, with the valve seat provided at one end thereof.

The insulator may be supported in a shell which incorporates a connection means for connecting the first portion to the engine. Conveniently, the shell may be constructed of metal or other electrically conductive material. Typically, the connection means comprises a male boss portion for engaging a bore provided in the cylinder head of the engine. Engagement with the bore may be by way of a slip fit, threaded engagement or any other suitable means. Conveniently, the boss portion is threaded such that it may threadingly engage the bore in the engine cylinder head. The shell may also incorporate a hexagonal portion defining a nut by means of which the first portion can be rotated into and out of threaded engagement with the bore. The secondary electrode may extend from the male boss portion.

A resiliently flexible seal may be provided on the insulator at a location adjacent the shell to establish a sealing connection between the first and second portions.

A pole-piece may be located on one end of the valve housing adjacent the end thereof opposite to the valve seat. The pole-piece may comprise a ferromagnetic body having a central bore in which the valve stem is slidably received. The pole-piece may be disposed between the armature and the ceramic insulator, with the working gap of the electromagnetic means existing between the pole-piece and the armature to accommodate limited axial movement of the valve stem for moving the valve member into and out of sealing engagement with the valve seat. Conveniently, the valve control spring is accommodated in a cavity defined between the pole-piece and the armature, with the spring acting between the pole-piece and the armature to bias the valve stem through the armature into engagement with the valve seat.

A terminal portion may be provided on the first portion at the end thereof opposite the delivery port. The terminal portion is preferably separated from the armature and is fixed to the pole-piece by way of a cylindrical shroud which surrounds the armature. With this arrangement, the armature is accommodated within the confines of the shroud. The terminal portion may define a male connector which includes a central bore forming part of the first flow path section and which registers with the central bore in the valve stem across a space separating the terminal portion and the armature. The shroud serves to provide a connection between the terminal portion and the pole-piece and to enclose the space between the armature and the terminal portion to thereby maintain the integrity of the first flow path section.

The shroud also serves to guide the axial movement of the armature upon movement of the valve member into and out of engagement with the valve seat.

The second portion is preferably in the form of a cap structure which fits onto the first portion and in which the solenoid coil is accommodated. With such an arrangement, the second portion includes a housing having a cavity with an open end through which the first portion is received.

The second portion may include a delivery tube having a central bore defining part of the second flow path section. The delivery tube may include a female connector adapted to sealingly receive the male connector defined by the terminal portion on the first portion. The other end of the delivery tube may define a connector adapted for sealing connection with a fuel supply, such as a fuel and air supply rail.

A section of the delivery tube may be surrounded by a core magnetic tube which extends beyond one end of the delivery tube to define part of the cavity within the housing. The core magnetic tube is preferably surrounded by electrically insulating material.

The solenoid coil may be adapted for connection to a solenoid control circuit by way of an electrical supply line which extends between the solenoid coil and a low tension terminal attached to the housing.

A high tension terminal, such as a terminal stud, may also be connected to the housing. Conveniently, a high voltage current path exists between the high tension terminal and the primary electrode when the first and second portions are connected together. Various electrically conductive components within both the first and second portions are utilised to establish the high voltage current path between the high tension terminal and the primary electrode. Conveniently, the high voltage current path between the first and second portions is completed by the interaction of the core magnetic tube of the second portion with the cylindrical shroud of the first portion. Alternatively, or in conjunction with this, the high voltage current path between the first and second portions is completed by the interaction of the core magnetic tube and the pole-piece.

The invention also provides a fuel delivery injector for a spark-ignition internal combustion engine, comprising a first portion and a second portion adapted to be detachably connected to the first portion, wherein;

(a) the first portion has a delivery port defined between a valve seat and a valve member movable with respect to the valve seat for opening and closing the delivery port, a solenoid armature provided in the first portion and operatively connected to the valve member, and a solenoid coil provided in the second portion whereby when the first and second portions are connected together the solenoid coil is operably associated with the solenoid armature; and (b) the first portion defines a first flow path section and the second portion defines a second flow path section, whereby the two flow path sections co-operate to define a fuel flow path for delivery of a fuel charge to the delivery port when the first and second sections are connected together.

The invention further provides a combined fuel injection and ignition means for a spark-ignition internal combustion engine, comprising a first portion and a second portion adapted to be detachably connected to the first portion, wherein:

(a) the first portion has a delivery port defined between a valve seat and a valve member movable with respect to the valve seat for opening and closing the delivery port, a solenoid armature provided in the first portion and operatively connected to the valve member, and a solenoid coil provided in the second portion whereby when the first and second portions are connected together the solenoid coil is operably associated with the solenoid armature;

(b) the first portion defines a first flow path section and the second portion defines a second flow path section, whereby the two flow path sections co-operate to define a fuel flow path for delivery of a fuel charge to the delivery port when the first and second sections are connected together; and (c) the first and second portions when connected together co-operate to define a high voltage current path forming part of an ignition circuit.

The ignition circuit may include two electrodes separated by a spark gap, one of the electrodes preferably being mounted on the valve member. The other electrode may be mounted on the first portion and electrically insulated from said one electrode,

BEST MODE FOR CARRYING OUT THE INVENTION

Figure 1:
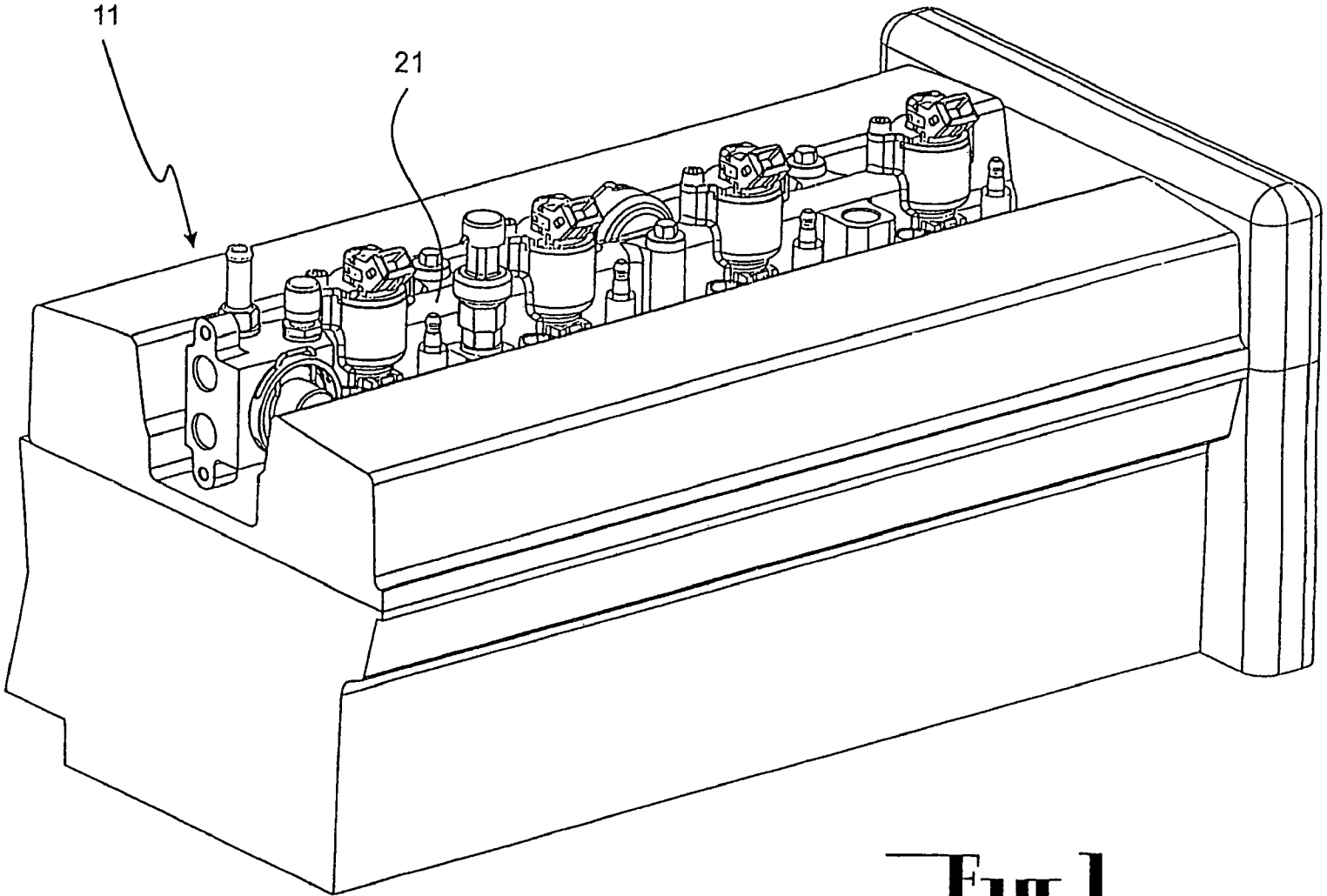
FIG. 1 is a schematic perspective view of a typical twin cam internal combustion engine cylinder head having a combined injection and ignition means according to the present invention located thereon.

Referring to the drawings, the device 10 according to the embodiment provides a combined fuel injection and ignition means for a reciprocating-piston, spark-ignition internal combustion engine. Whilst the invention will in the main be described in relation to a four cylinder four stroke engine, it is to be appreciated that the invention is equally applicable to other engine configurations having any number of cylinders or valves, whether of the four or two stroke type.

Figure 2:
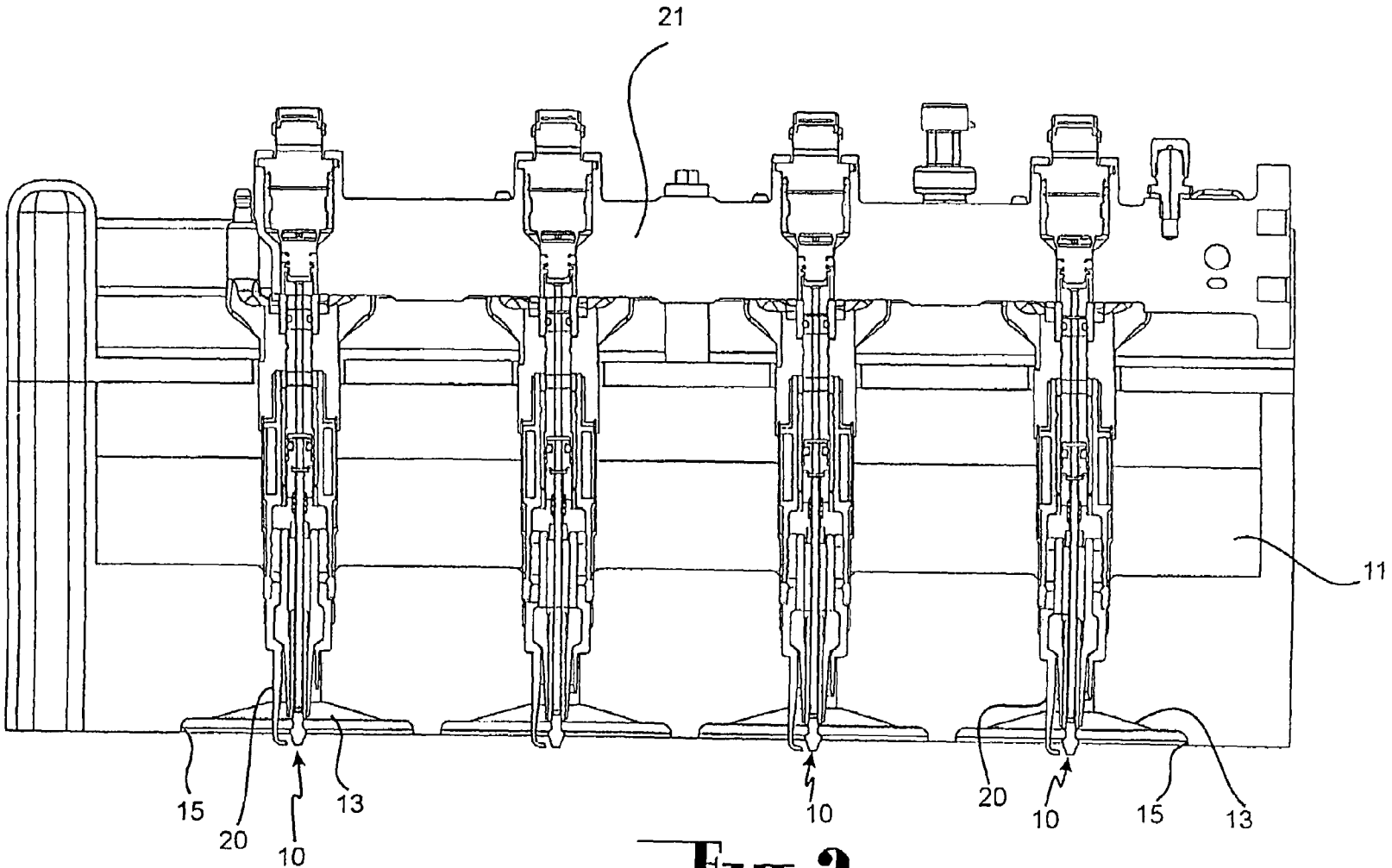
FIG. 2 is a sectional elevational view of the cylinder head of FIG. 1.
Figure 3:
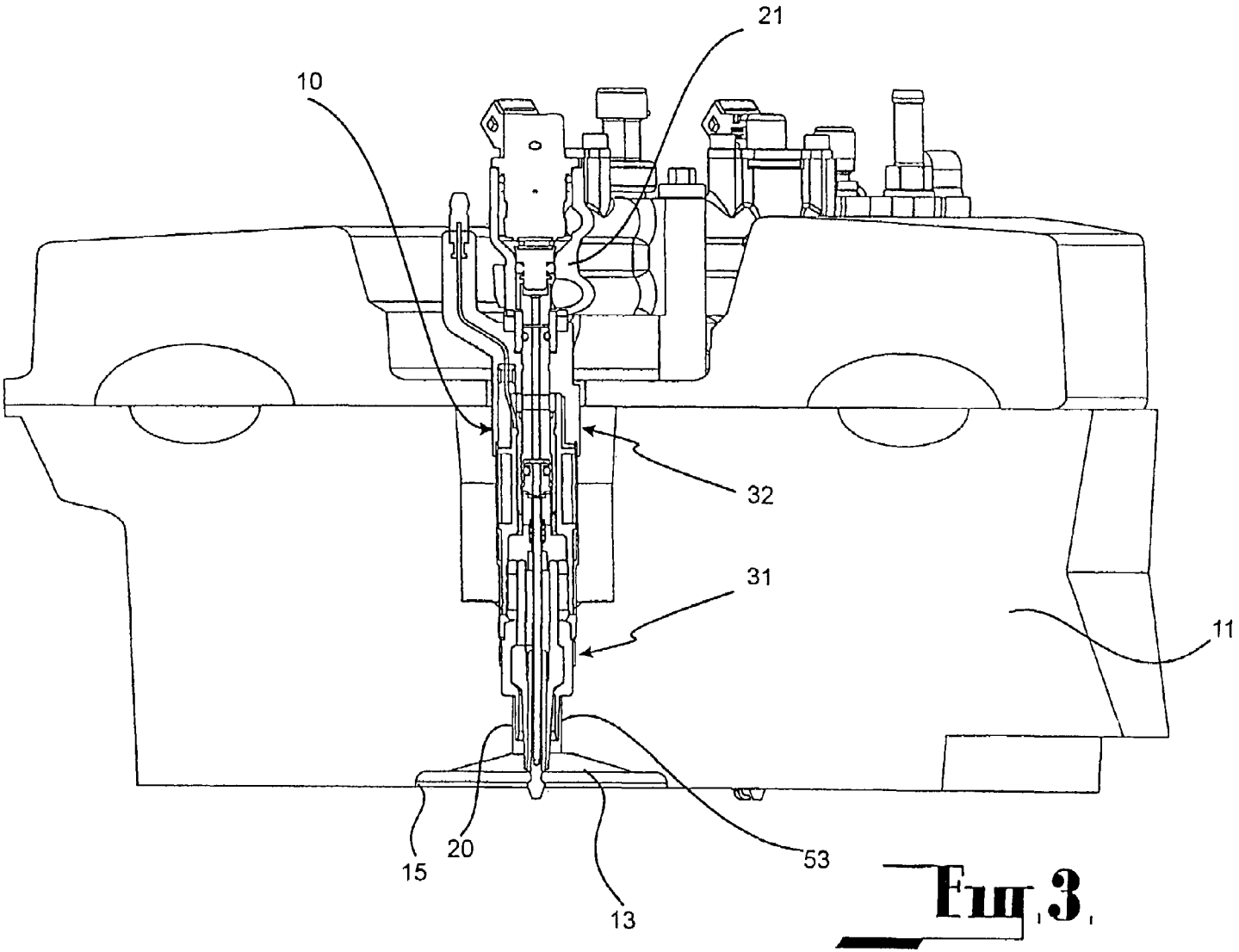
FIG. 3 is a sectional fragmentary view of the cylinder head of FIG. 1, with the section taken through a high tension lead forming part of the combined injection and ignition means.

As is evident from the cylinder head 11 shown in FIGS. 1, 2 and 3, the engine referred to in this embodiment has a plurality of combustion chambers 13 into each of which fuel is delivered by way of a direct injection process utilising one of the devices 10. Each combustion chamber 13 comprises a cylinder 15 and a piston (not shown) mounted for reciprocation in the cylinder 15. The cylinder head 11 incorporates bores 20 into each of which one of the devices 10 is secured by threaded engagement, A supply rail 21 is provided for supplying fuel and air to each device 10.

Each device 10 selectively delivers a charge of fuel entrained in air to its respective combustion chamber 13 in timed sequence with operation of the engine. The air is present to assist in injection of the fuel into the engine. While a fuel can be entrained in the air in any suitable way, it is particularly convenient to utilise the features of the fuel injection apparatus disclosed in U.S. Pat. Nos. 4,693,224 and RE 36,768 which have been assigned to the Applicant, the contents of which are incorporated herein by way of reference. Whilst the invention will primarily be described hereinafter in respect of a dual fluid fuel injection system, it is to be understood that the invention is equally applicable to single fluid fuel injection systems. Furthermore, it is to be appreciated that the invention is equally applicable whether for use with liquid fuels or with gaseous fuels such as LPG, LNG and CNG.

The device 10 comprises a first portion 31 and a second portion 32, the two portions being adapted to be releasably connected together to provide an operating assembly.

The first portion 31 comprises a body 33 having an intake end section 35 and a delivery end section 36 which incorporates a delivery port 37. A flow path 39 exists between the intake end section 35 and the delivery end section 36. The body 33 accommodates a ceramic insulator 41 surrounding a valve housing 43 of tubular construction with a central bore 45. The ceramic insulator 41 incorporates a nose section 47 beyond which the adjacent end of the valve housing 43 extends slightly.

The ceramic insulator 41 is supported in a metallic shell 51 which incorporates a threaded male boss portion 53 for threadingly engaging the respective bore 20 provided in the cylinder head 11, and a hexagonal portion 55 defining a nut by means of which the first portion 31 can be rotated with a tool to screw it into engagement, and unscrew it out of engagement, with the bore 20 in the cylinder head 11. As alluded to hereinbefore, male portion 53 does not necessarily require to threadingly engage the bore 20 and other suitable engagement means may be used. For example, the male portion 53 may simply be sized to provide a snug slip fit when inserted into the respective bore 20. In this way, the bore 20 or access hole in the cylinder head may be specifically sized and arranged to receive the male portion 53 in a particular orientation without the requirement that the bore 20 be of a larger size so as to permit rotation of the first portion 31. Further, the shell 51 need not always be metallic and in certain applications other suitable materials may be used.

An electrode 57 extends from the male boss portion 53 to define a secondary electrode for an ignition circuit. The ignition circuit also includes a primary electrode 58 which co-operates with the secondary electrode 57 to define a spark gap 60.

The portion of the ceramic insulator 41 beyond the metallic shell 51 is surrounded by a resiliently flexible seal 64 which assists in establishing a sealing connection between the first and second portions 31, 32, as will be explained in more detail later.

The fuel-air charge is conveyed to the delivery port 37 along the flow path 39 and is delivered to the combustion chamber 13 as a spray issuing from the delivery port 37 when opened.

The delivery port 37 is defined by co-operation between a valve 59 and a valve seat 61. The valve seat 61 comprises an annular surface of frusto-conical form provided on the delivery end of the valve housing 43. The valve 59 comprises a valve member 63 at one end of a valve stem 65. The valve member 63 has a sealing face movable into and out of engagement with the valve seat 61 for opening and closing the delivery port 37. A poppet projection 62 of frusto-conical shape depends from the valve member 63, the configuration thereof being such as to provide a fuel spray guidance affect during operation of the device 10. In the embodiment described, the primary electrode 58 is in effect provided by the poppet projection 62. It is however to be appreciated that the primary electrode 58 could be provided by a valve member 63 which does not have a projection dependent therefrom. In such an alternative, the secondary electrode 57 may be arranged to be slightly shorter in length such that the spark gap 60 may be between the valve member 63 and the secondary electrode 57. Further, the valve member 63 of the embodiment is shown to be of the outwardly opening or poppet type. Whilst this type of valve may be more suited to a combined injection and ignition device, it is to be appreciated that the benefits of the present invention may be equally applicable to an inwardly opening or pintle type valve of suitable construction.

The valve stem 65 is of hollow construction to provide a central bore 69 which forms part of the flow path 39. Openings 71 are provided in the wall of the valve stem 65 to permit the fuel-air charge to pass from the central bore 69 to an outer zone 73 from where it can be delivered into the combustion chamber 13 upon opening of the delivery port 37. Such a hollowed valve stem 65 is disclosed in the Applicant's U.S. Pat. No. RE 36,768, the contents of which are incorporated herein by reference.

The valve stem 65 has a guide portion 75 which is axially slidable in the bore 45 within the valve housing 43 for guiding axial movement of the valve 59 and hence the valve member 63 as it moves into and out of sealing engagement with the valve seat 61. A valve control spring 81 is provided to bias the valve 59 into a condition in which the valve member 63 is in seating engagement with the valve seat 61, thereby closing the delivery port 37.

Figure 4:
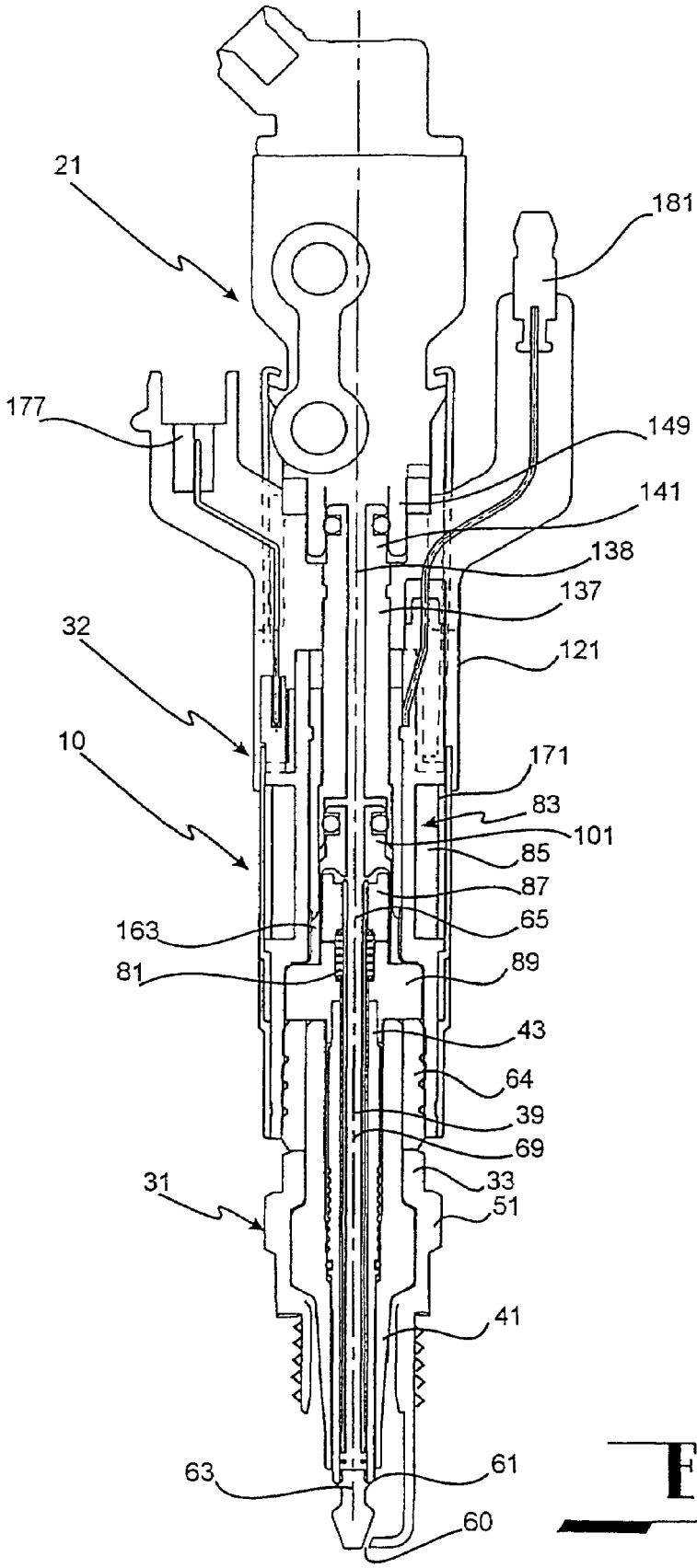
FIG. 4 is a sectional side view of the combined injection and ignition means, with first and second portions thereof shown connected together.
Figure 5:
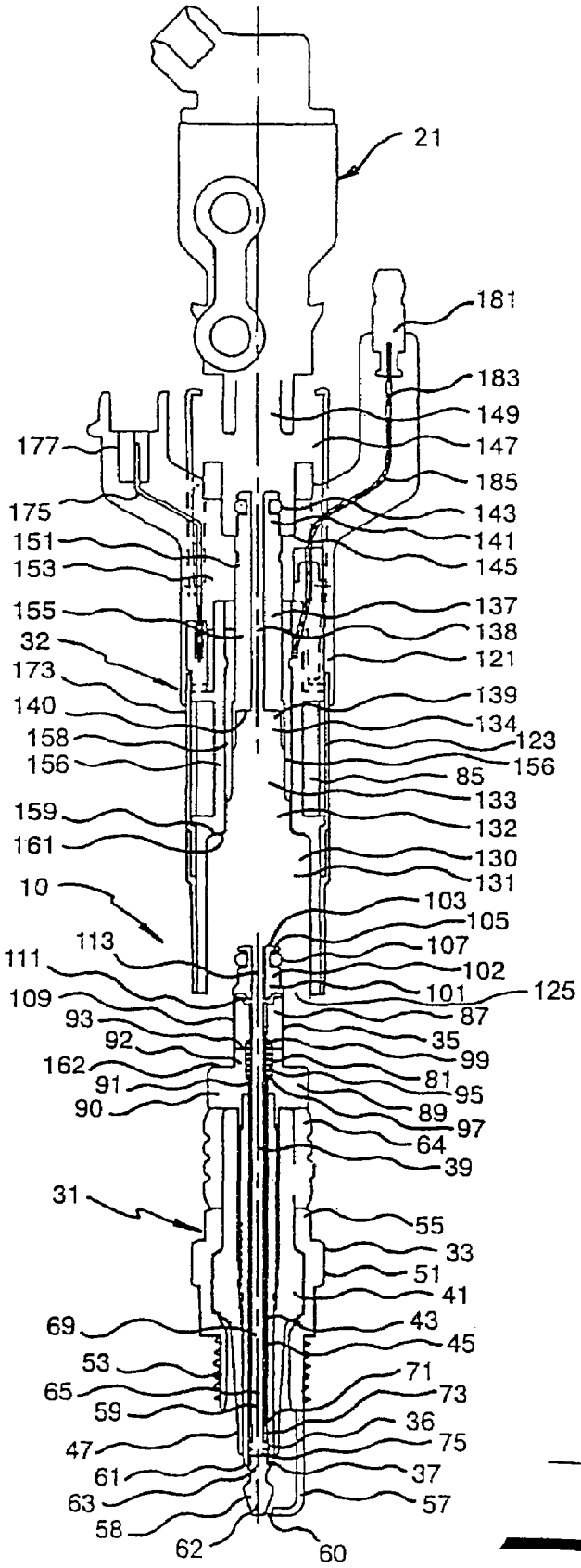
FIG. 5 is a sectional view similar to FIG. 4 with the exception that the first and second portions are shown in a separated condition.
Figure 6:
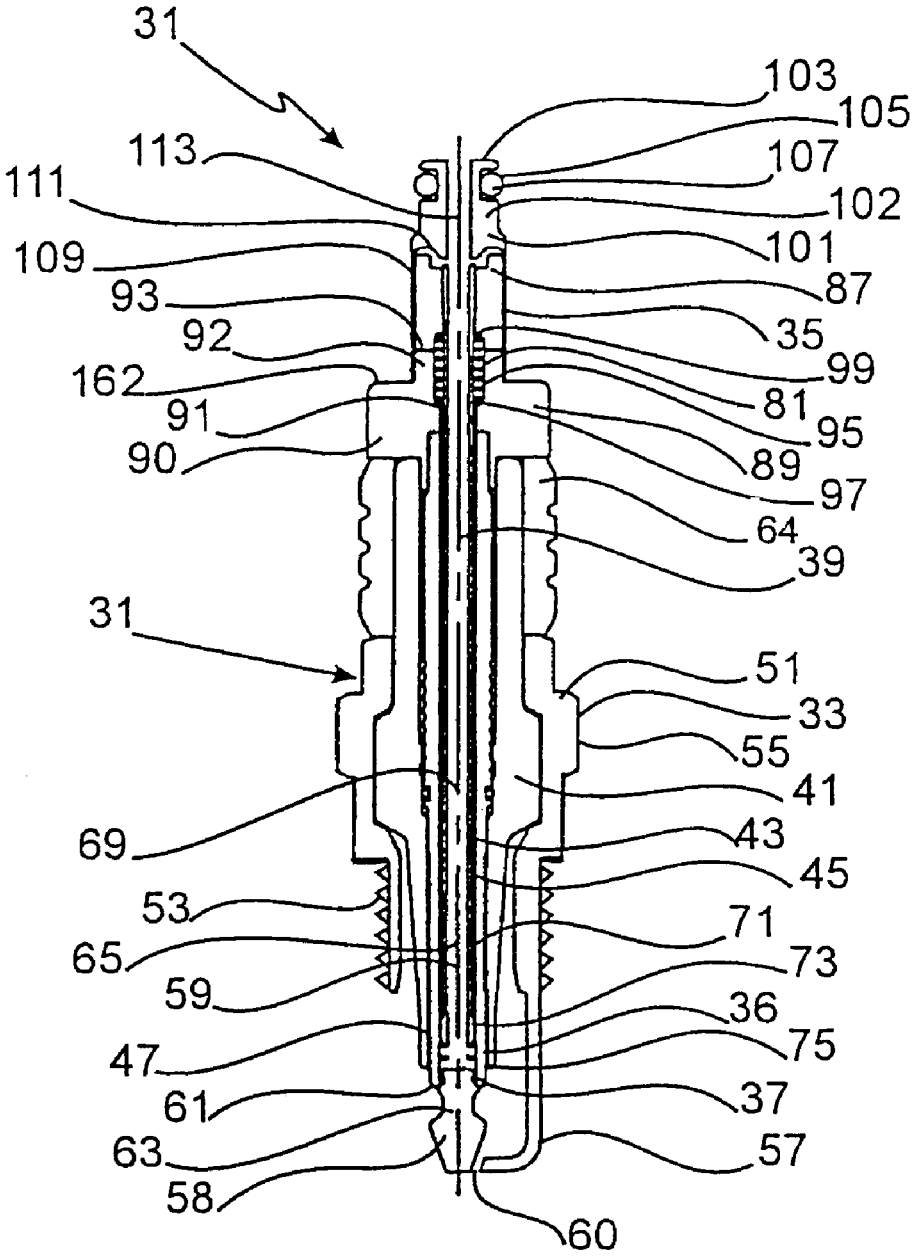
FIG. 6 is a sectional side view of the first portion.
Figure 7:
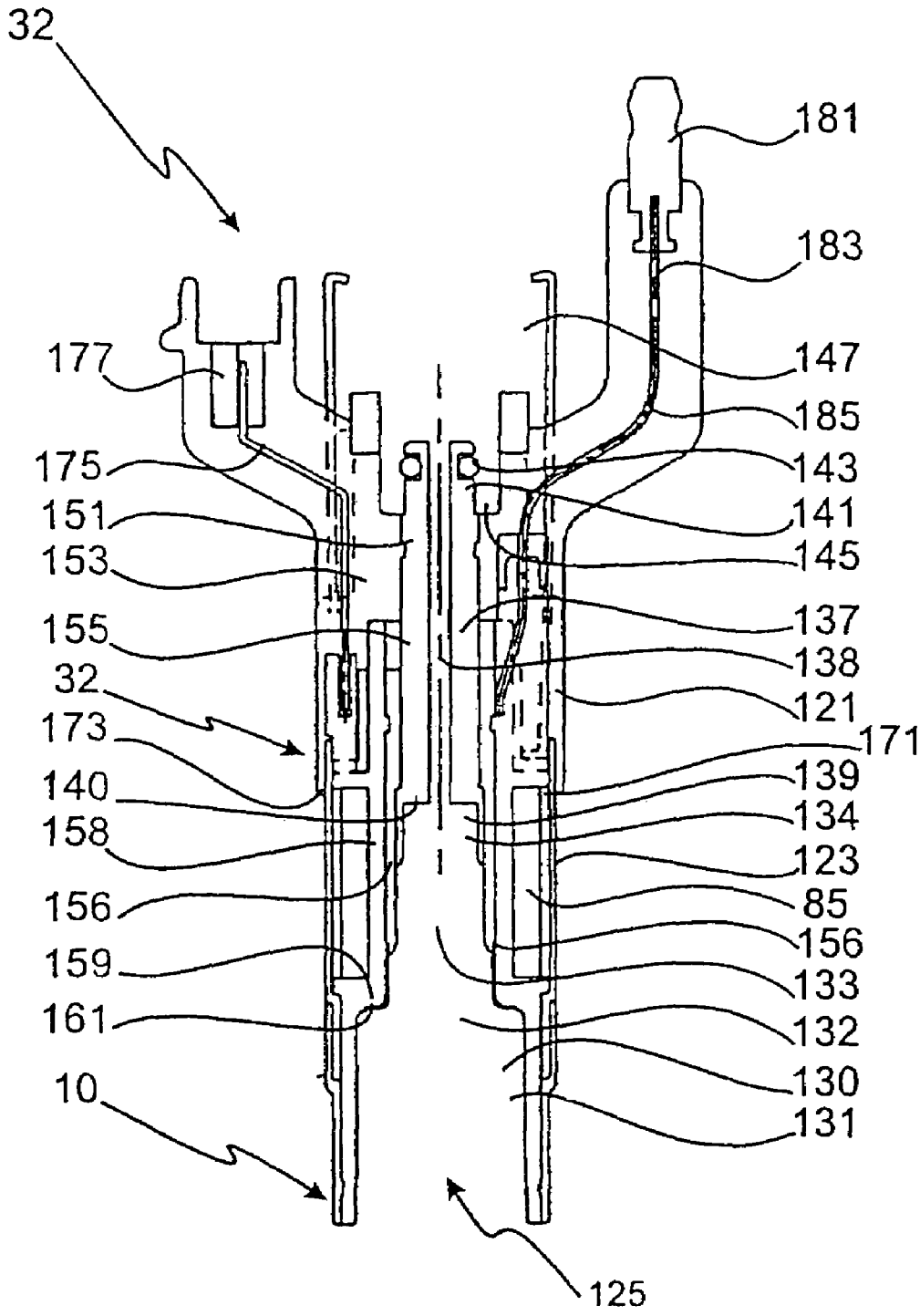
FIG. 7 is a sectional side view of the second portion.

As best seen in FIG. 4, an electromagnetic means 83 is provided for selectively moving the valve 59 against the bias of the valve control spring 81 out of sealing engagement with the valve seat 61, thereby opening the delivery port 37. The electromagnetic means 83 is in the form of a solenoid having a solenoid coil 85 and an armature 87. The solenoid coil 85 is incorporated in the second portion 32, as will be explained in more detail later.

The armature 87 is attached to the valve stem 65 at the end thereof opposite the valve member 63. The valve 59, the armature 87 and the valve housing 43 in combination provide a valve assembly.

When the first and second portions 31, 32 are connected together to provide an operating assembly (as best seen in FIG. 4), the solenoid coil 85 is disposed concentrically about the armature 87 on the valve 59 so that energisation of the solenoid coil 85 induces movement of the valve 59 against the influence of the valve control spring 81 to open the delivery port 37.

A pole-piece 89 is located on one end of the valve housing 43 adjacent the end thereof opposite the delivery end section 36. The pole-piece 89 comprises a metallic body having a larger section 90 and a smaller section 92, with a central bore 91 extending therethrough in which the valve stem 65 is arranged for upwards and downwards movement. The pole-piece 89 is disposed between the armature 87 and the ceramic insulator 41, with a working gap 93 existing between the pole-piece 89 and the armature 87 to accommodate limited axial movement of the valve 59 in moving the valve member 63 into and out of sealing engagement with the valve seat 61. The valve control spring 81 is accommodated in a cavity 95 defined by two opposed recesses 97, 99 in the pole-piece 89 and armature 87 respectively.

The intake end section 35 of the body 33 further incorporates a terminal portion 101 having a male connector 102 which is adapted to sealingly engage with the second portion 32 of the device 10 in a manner to be described later. The terminal portion 101 includes an end face 103 through which the flow path 39 opens. A circumferential recess 105 is spaced inwardly from the end face 103 and receives a seal 107 in the form of an O-ring.

The terminal portion 101 is separate from the armature 87 and is fixedly located on one end of a cylindrical shroud 109, the other end of which is fixedly located on the pole-piece 89. With this arrangement, the armature 87 is accommodated within the confines of the shroud 109. The terminal portion 101 is reduced inwardly from the shroud 109 to define the male connector 102 and includes a central bore 113 which forms part of the flow path 39 and which registers with the central bore 69 in the valve 59 across the space 111 which separates the terminal portion 101 and the armature 87. The shroud 109 serves to provide a connection between the terminal portion 101 and the pole-piece 89, and to enclose the space 111 between the armature 87 and the terminal portion 101 to thereby maintain the integrity of the flow path 39.

The shroud 109 also serves to prevent the ingress of foreign matter into the device in the region of the armature 87, and more particularly the working gap 93. Furthermore, the shroud 109 serves to guide the axial movement of the armature 87 and, in doing so, co-operates with the guide portion 75 to guide axial movement of the valve 59 and hence the valve member 63 as it moves into and out of sealing engagement with the valve seat 61.

As previously mentioned, the second portion 32 of the device 10 is adapted to be releasably connected to the first portion 31 so as to provide an operating assembly. The second portion 32 is in the form of a cap structure which fits onto the first portion 31. More particularly, the second portion 32 includes a housing 121 which has a cylindrical side wall 123 and an open end 125 which receives the first portion 31 in a manner to be described later.

The housing 121 has a central cavity 130 which extends inwardly from the open end 125. The central cavity section 130 has four cavity sections, being a first cavity section 131, a second cavity section 132, a third cavity section 133 and a fourth cavity section 134. As best seen in FIG. 4 of the drawings, when the first and second portions 31, 32 are connected together to form an operating assembly, the resiliently flexible seal 64 and the larger section 90 of the pole-piece 89 on the first portion 31 are received in the first cavity section 131, the smaller section 92 of the pole-piece 89 and part of the shroud 109 are received in the second cavity section 132, the remaining part of the shroud 109 and part of terminal portion 101 are received in the third cavity section 133, and the male connector 102 defined by the terminal portion 101 is received in the fourth cavity section 134.

The second portion 32 includes a tube defining a delivery line 137 having a flow path 138 for delivering fuel and/or air from the supply rail 21 to the fluid flow path 39 in the first portion 31. The delivery tube 137 includes a female connector 139 adapted to sealingly receive the complimentary male connector 102 defined by the terminal portion 101 on the first portion 31. The female connector 139 has an internal end face 140 adapted to abut against or be adjacent to the end face 103 of the male connector 102. The O-ring seal 107 maintains the integrity of the seal between the male and female connectors 102, 139 to thereby maintain the integrity of fluid flow between the flow path 138 in the delivery tube 137 and the flow path 39 in the first portion 31. The other end of the delivery tube 137 defines a male connector 141 incorporating a seal in the form of O-ring 143 for sealingly connecting the second portion 32 to the supply rail 21 for receiving a supply of fuel and/or air to provide the fuel-air charge. The male connector 141 is accommodated in a cylindrical recess 145 which forms part of a cavity 147 in the housing 121. The cavity 147 is adapted to receive the respective connecting parts of the supply rail 21 including a female connector 149 on the supply rail for engaging the male connector 141.

In an alternative design, the delivery tube 137 may be provided with a long cylindrical extension at the end face 140 which engages with the central bore 113 of the male connector 102. Furthermore, the tube 137 may be of a dielectric plastic material so as to provide an insulated path inside the connector 102 without disrupting the flow path 138 and requiring an increase in the height of the device 10. Such an alternative may, in certain designs, offer advantages in regard to preventing electrical conduction and tracking from the first portion 31 to the second position 32.

A section 151 of the delivery tube 137 is encased in an insulating body 153 formed of electrically insulating material within the housing 121. A further section 155 of the delivery tube 137 is surrounded by a core magnetic tube 156 which extends beyond the end of the delivery tube 137 to define the third cavity section 133 of the central cavity 130 within the housing 121. The core magnetic tube 156 is formed of electrically conductive ferromagnetic material.

The core magnetic tube 156 is surrounded by an electrically insulating sleeve 158. The sleeve 158 extends from the insulating body 153 to the open end 125 of the housing 121 and incorporates an internal step 159 where it changes from a section defining the second cavity section 132 to a larger section defining the first cavity section 131. The step 159 forms an annular face 161 adapted to bear against a radial face 162 on the larger section 90 of the pole-piece 89 of the first portion 31. The housing 121 includes an outer covering 173 formed in sections connected together.

It is, however, envisaged that the insulating body 153 and insulating sleeve 158 may be part of the same bobbin insulator without the need for any joints or separate sections therebetween. In this way, these two components can be injection molded as a single unit, allowing for a simplified design and the elimination of one assembly process. Such a design would maintain the insulation of the solenoid coil 85 from the high voltage current path (as will be further described hereinafter) whilst enabling some narrowing of the diameter of the second portion 32.

As best seen in FIG. 4, there is a space 163 defining an annular air gap in the second cavity section 132 between the housing 121 and first portion 31 for the purposes of accommodating any misalignment between the first and second portions 31, 32 when they are connected together to provide a working assembly.

The solenoid coil 85 is accommodated within the housing 121 and is surrounded by a ferromagnetic casing 171. The solenoid coil 85 is positioned concentrically about the third and fourth cavity sections 133 and 134 respectively, as well as partly about the second cavity section 132, so as to be positioned concentrically around the armature 87 of valve 59 when the first and second portions 31, 32 are connected together to provide an operating assembly. With this arrangement, the solenoid coil 85 is operably arranged with respect to the armature 87 to form the electromagnetic means 83.

The solenoid coil 85 is connected to a control circuit (not shown) by way of an electrical supply wire 175 which extends between the solenoid coil 85 and a low tension terminal stud 177 attached to the housing 121. In certain applications, two terminal studs 177 may be provided with one of the studs 177 serving as an earth connection.

A high tension terminal stud 181 is also connected to the housing 121. A high voltage current path 183 exists between the high voltage stud 181 and the primary electrode 58. Various electrically conductive components within both the first and second portions 31, 32 are utilised to establish the current path 183 between the high tension terminal stud 181 and the primary electrode 58. The current path 183 includes a wire conductor 185 connected between the terminal stud 181 and the core magnetic tube 156 which is of electrically conductive material, The wire conductor 185 is encased in the body 153 of insulating material. When the first and second portions 31, 32 are connected together, the current path 183 continues by virtue of intimate contact between the core magnetic tube 156 and the shroud 109 on the first portion 31. The current path 183 continues along the shroud 109 and the pole-piece 89 to the valve stem 65 and thereafter to the valve 59 which delivers high tension power to the primary electrode 58 projecting from the valve member 63. The high voltage power may also follow a path from the shroud 109 to the armature 87 and along the valve stem 65 to the primary electrode 58. The core magnetic tube 156 is a key component of the high voltage current path as it takes the high voltage current down through the core of the device 10 and facilitates its transfer to the first portion 31. By virtue of its configuration and the way in which it interacts with the first portion 31, it also contributes to shortening the overall assembly.

It is however to be appreciated that the shape and configuration of some of these elements may be varied without detracting from the overall feature that the current path is completed when the first and second portions 31, 32 are coupled together. For example, the core magnetic tube 156 and the insulating sleeve 158 may be modified such that the magnetic tube 156 contacts the polepiece 89 when the first and second portions 31, 32 are coupled together. In this case, the high tension current path is primarily provided, for example, by virtue of the engagement between the pole-piece 89 and the annular face 161. Further, where necessary, the core magnetic tube 156 and the insulating sleeve 158 may comprise a combination of magnetic and non-magnetic material as desired which, for example, may provide certain benefits in regard to the prevention of arcing across to the intake end section 35 of the first portion 31.

Figure 8:
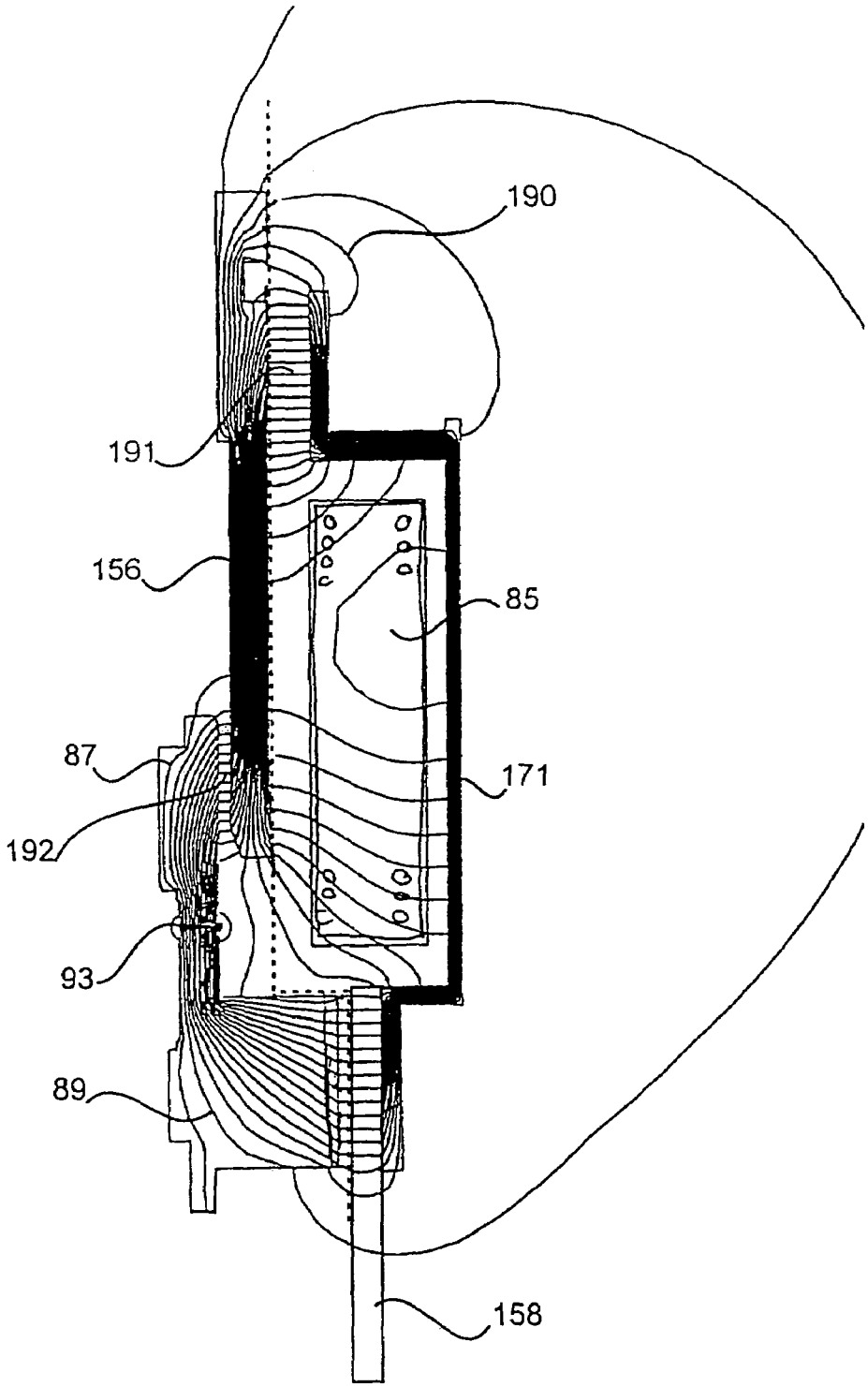
FIG. 8 is a fragmentary view showing schematically a magnetic circuit which is established within the combined ignition and injection means during operation thereof.

The magnetic circuit established upon energisation of the solenoid coil 85 is illustrated in FIG. 8 of the drawings which is a fragmentary view showing, in cross-section, the solenoid coil 85, the core magnetic tube 156, the armature 87, the working gap 93, the pole-piece 89, the insulating sleeve 158 and the casing 171. It is to be noted that only one side of a section about a centreline of the device is shown, as is evidenced by only one side of the solenoid coil 85 being depicted in the figure.

Prior to energisation of the solenoid coil 85, the valve 59 is biased into sealing engagement with the valve seat 61 by virtue of the valve control spring 81, and the working gap 93 exists between the armature 87 and the pole-piece 89. Upon energisation of the solenoid coil 85, a magnetic circuit is established. The theoretical lines of magnetic flux resulting from establishment of the magnetic circuit are depicted in FIG. 8 and identified by reference numeral 190. The increased concentration of flux lines in parts of the magnetic circuit relates to areas where the magnetic flux is of greater density. The lines of magnetic flux follow a circuit in which they pass from the ferromagnetic casing 171, across insulating material at 191 to the core magnetic tube 156. The lines of magnetic flux 190 pass down the core magnetic tube 156, across gap 192 and through the metallic shroud 109 to the armature 87. From the armature 87, the lines of flux move across the working gap 93 and enter the pole-piece 89. The flux lines then pass across the insulating sleeve 158 and return to the ferromagnetic casing 171, as well as passing through the surrounding insulating material.

In passing across the working gap 93, the magnetic flux generates a force across the gap which draws the armature 87 towards the pole-piece 89 against the influence of the valve control spring 81. This movement of the armature 87 moves the valve 59 and hence the valve member 63 out of sealing engagement with the valve seat 61 to open the delivery port 37 for injection of the fuel-air charge into the combustion chamber 13. The extent of movement of the armature 87, and consequently the valve 59, is limited by the size of the working gap 93.

A particular feature of the embodiment is that various parts of the first and second portions 31, 32 (which together define the fuel flow path through the overall assembly) are utilised in establishing both the magnetic circuit for operating the valve 59, and the high tension voltage circuit for ignition purposes. A further feature of the embodiment is that the first and second portions 31, 32 are, so far as the magnetic circuit is concerned, coupled (and hence separable) along radial lines of flux. This is particularly advantageous in that the magnetic circuit is tolerant to slight variations in the axial engagement of the first and second portions 31, 32. That is, there is a certain degree of tolerance in respect of the height of the gap 192.

In use, the first portion 31 is fitted in position in the cylinder head 11 through threaded engagement with the bore 20. With this arrangement, the delivery end section 36 of the device 10 communicates with the respective combustion chamber 13 into which a metered quantity of fuel entrained in air is to be delivered in timed sequence with operation of the engine. The first portion 31 can simply be screw-threaded into the desired position and there is no need for it to assume any particular orientacion when in its final position. The second portion 32 can then simply be placed onto the first portion 31, with the intake end section 35 of the first portion 31 being received in the central cavity 130 of the second portion 32 as previously described. While the second portion 32 does need to be positioned in a specific orientation in order to properly register with the supply rail 21, this can be achieved quite simply as no particular orientation with respect to the first portion 31 is required. The second portion 32 is simply pushed onto the first portion 31 in the manner of a cap and is rotated so as to assume the required orientation with respect to the supply rail 21. When fully engaged, the annular face 161 of the second portion 32 bears against the radial face 162 of the pole-piece 89 of the first portion 31 whilst the internal end face 140 of the second portion 32 is rendered adjacent to and in close proximity to the end face 103 of the first portion 31.

Still further, the particular design of the first and second portions 31, 32 and the way in which they come together allows for a certain degree of lateral flexibility therebetween. That is, as well as being able to axially pivot on the first portion 31, a limited degree of lateral movement between the second portion 32 and the first portion 31 is also able to be accommodated. This limited movement is primarily possible due to the small degree of axial misalignment between the intake end section 35 and the central cavity section 130 to which the device 10 is tolerant. The flexible seal 62 also contributes to this limited degree of lateral flexibility. Such tolerance may be useful during assembly on the engine cylinder head 11 wherein such lateral and axial flexibilities facilitate ease of connection to the supply rail 21 and other electrical and mechanical connections.

When the first and second portions 31, 32 are connected together to provide an operating assembly, the resiliently flexible seal 62 is snugly received within the first cavity section 131 of the central cavity 130 within the housing 121. This is particularly advantageous in that intimate contact between the seal 62 and the insulating sleeve 158 maintains the integrity of insulating characteristics between the first and second portions 31, 32.

When the first and second portions 31, 32 are connected together to provide an operating assembly, they co-operate with each other to perform three separate functions namely: (a) assembly of the electromagnetic means 83 which creates the magnetic circuit upon energisation of the solenoid coil 85, (b) establishment of the path along which fuel and/or air is delivered to the combustion chamber 13, and (c) establishment of the high tension current path along which high tension power can be delivered from the high voltage terminal stud 181 to the primary electrode 58. Functions (a), (b), and (c) can be attained simply and easily, merely by assembling the first and second portions 31, 32 together.

In operation, a metered quantity of fuel is delivered along a flow path established by the paths 138 and 39 in combination, the paths 138 and 39 being in communication with a source of pressurised air by virtue of connection to an air rail (not shown) within the supply rail 21. The operation of the dual fluid fuel system according to the embodiment resembles the system as disclosed in the Applicant's U.S. Pat. No. RE 36,768, the contents of which are incorporated herein by reference, and as such, the operational details of such a dual fluid fuel system will not be recited in any further detail in this description. A metered quantity of fuel entrained in air is delivered in timed sequence into the combustion chamber 13 upon opening of the delivery port 37. The delivery port 37 is normally closed. The solenoid coil 85 is energised by a current delivered thereto along the low tension wire 175. Energisation of the solenoid coil 85 draws the armature 87 towards the pole-piece 89 against the influence of the valve control spring 81 to close the working gap 93. This movement of the armature 87 causes a corresponding movement of the valve 59 to thereby move the valve member 63 out of engagement with the valve seat 61 and so open the delivery port 37. The fuel-air charge confined within the flow path 39 and the outer zone 73 is then injected into the combustion chamber 13. After the prescribed injection period; the energisation current delivered to the solenoid coil 85 is terminated, so terminating the magnetic influence on the armature 87 and allowing the valve member 63 to return to its normal position in engagement with the valve seat 61 thereby closing the delivery port 37.

During typical operation of the device 10, shortly after the delivery port 37 is closed, an ignition event is effected at the spark gap 60 to combust the fuel and air mixture present in the combustion chamber 13. This ignition event is also effected by the device 10 wherein a high voltage signal is applied to the device 10 via the high voltage stud 181 to cause a current to flow through the device 10 and generate a spark between the primary and secondary electrodes 58, 57. Hence, both the delivery of fuel to the engine and the ignition thereof are performed by the one assembly.

It should be noted that the ignition event need not be limited to occurring after the fuelling event has occurred. That is, even though the low voltage current path and the high voltage current path comprise some similar elements of the device 10, this does not limit the operation of the device 10 and an ignition event is able to occur simultaneously with a fuel delivery event if such overlap is desired.

Whilst the embodiment has been described wherein the valve stem 65 of the valve 59 is of hollow construction, the invention is equally applicable to such devices where the valve stem 65 may be solid. For example, so far as the first portion 31 is concerned, fluid delivered to the intake end section 35 may be permitted to flow around the armature 87, through the cavity 95 within which the valve control spring 81 is accommodated and down along the outside of the valve stem 65 (ie within the central bore 45 of the valve housing 43). The openings 71 would hence not need to be provided in the wall of the valve stem 65 as the fluid would ultimately proceed to the outer zone 73 from where it can be delivered to the engine upon opening of the delivery port 37. Further, where certain benefits are able to be realised by having fluid flow along the path as described above, the first portion 31 may be designed to permit such fluid flow to occur as well as providing for fluid to flow through a hollowed valve stem 65 as has been discussed hereinbefore.

Construction of the device 10 as an assembly of two parts (being the first and second portions 31, 32) is particularly advantageous. It allows the device to be installed in a simple and convenient manner as previously described, without the need to be concerned with alignment of the device 10 with respect to the supply rail 21 when the first portion 31 is screwed into engagement with the cylinder head 11. Furthermore, the device 10 can be easily removed for servicing and repair operations as necessary.

Whilst not limited as such, the combined injection and ignition device according to the present invention has particular applicability to direct injected four stroke engines. In such engines, it is often a challenge to arrange a plurality of intake and exhaust valves, a fuel delivery injector and a sparking means in the cylinder head portion associated with a respective cylinder, particularly in light of the requirement to also allow for the presence of lubrication and/or cooling galleries in the cylinder head. By providing the injection and ignition functions by way of a single device, the problem of limited space and reduced design flexibility encountered when developing direct injected four stroke multi-valve engines may be reduced.

A further advantage of the arrangement is that the valve assembly involving the valve 59, valve housing 43 (including valve seat 61), and the armature 87 can be calibrated to ensure correct opening of the delivery port 37 upon displacement of the armature 87, prior to fitting the valve housing 43 into position within the ceramic insulator 41. Calibration is assisted by virtue of the fact that the components within the valve assembly, together with the polepiece 89, valve control spring 81, and terminal portion 101 are all of metallic construction and therefore less likely to be vulnerable to thermal influences, particularly differential rates of thermal expansion and contraction. Hence, the valve assembly, which is effectively a single, separate unit, is pre-calibrated prior to its insertion into the insulator 41. In contrast, known prior art devices can only be calibrated after full assembly, which is at a stage where both metallic and ceramic components are present. The presence of both metallic and ceramic components introduce difficulties arising from different rates of thermal expansion and contraction, so leading to unreliability in relation to calibration.

Yet a further advantage realised from the design of the device 10 is that only a single sealing element, the O-ring 107, is essentially required between the first portion 31 and the second portion 32. The fact that this O-ring 107 is arranged at the uppermost end of the intake end section 35 is also advantageous in that, in operation, it is well removed from the typically hot cylinder head 11 and combustion related components. Hence the integrity of the O-ring 107 is able to be maintained for an extended duration.

Nonetheless, the flexible seal 62 may also operate as a fluid seal in instances where there is some fault or leakage at the intake end section 35 when the first and second portions 31, 32 are coupled together. This may enable the device 10 to continue operating satisfactorily until the situation can be remedied and importantly will ensure that no leakage of fuel out of the device 10 will occur.

In this embodiment, the valve housing 43 is typically secured to the ceramic insulator 41 by way of adhesive bonding. It should be appreciated however that other arrangements are possible. For example, the valve housing 43 may be secured to the ceramic insulator 41 in a selectively detachable manner, such as by screw-threaded engagement. Such an arrangement would be advantageous for certain applications as it would allow replacement of the valve assembly as necessary, without the need to discard the ceramic housing 41 and other related components, and vice versa.

The first portion 31 of the device 10 also advantageously acts as a heat sink which enhances operation of the device 10. That is, the metallic valve assembly which typically contains a relatively lower temperature liquid fuel therein helps to maintain the temperature of the ceramic insulator 41 below a level which may lead to pre-ignition occurring. Hence, during operation, whilst the temperature of the insulator 41 exposed in the combustion chamber 13 would be sufficient to prevent the build-up of carbon deposits on the surface thereof, the presence of the valve housing 43 and fuel quantity therein which are immediately adjacent to the insulator 41 would enable a certain level of heat transfer to occur which prevents the ceramic insulator 41 from getting too hot. That is, the peak temperature of the insulator is rendered more stable.

A further advantage of the device 10 is that all of the necessary mechanical and electrical connections and interfaces are arranged to be made to or housed in the second portion 32. This is perhaps best highlighted by FIG. 4 which shows that the low tension terminal stud 177, the high tension terminal stud 181, and the appropriate fuel and/or air supply connections to the supply rail 21 are all effected via the second portion 32. This has certain obvious advantages including improved access to such connections and the fact that the delivery end section 36 of the device 10 does not require removal or access thereto if one or a number of connections require to be removed. In particular, a certain degree of axial rotation of the second portion 32 about the first portion 31 may serve to more adequately orient the various connections with respect to their corresponding connections.

Further, by arranging all of the electrical and fluid connections to be housed in the second portion 32, this serves to distance such connections from the higher temperatures which are likely to exist at the cylinder head 11 during operation.

It should, be understood that the scope of the invention is not limited to the scope of the embodiment described. In particular, it should be understood that the invention is not limited to a device which provides a combined fuel infection and ignition means. The invention can, for example, provide merely a fuel injection means which operates in association with an independent ignition means such as a conventional spark plug. Still further, certain aspects of the present invention may also be applicable to engines which do not require spark-ignition. Furthermore and as alluded to heretobefore, the invention is equally applicable whether predominantly liquid fuels or gaseous fuels are delivered by the delivery injector and irrespective of whether the fuel is delivered by way of air assistance in a dual fluid fuel system or by way of a more conventional single fluid fuel injection system.

Whilst aspects of the invention have in the main been described with reference to a single path combined ignition and injection device wherein fuel and high voltage ignition current follow substantially the same path, it is to be appreciated that certain features of the present invention are not necessarily limited to such a device. That is, specific features of the invention as described herein may have applicability to a combined ignition and injection device wherein fuel and high voltage ignition current do not follow a common path through the device.

Throughout the specification, unless the context requires otherwise, the word "comprise" or variations such as "comprises" or "comprising", will be understood to imply the inclusion of a stated integer or group of integers but not the exclusion of any other integer or group of integers.

Further details of the present invention are disclosed in International Patent Application No. PCT/AU00/01268, which was published on Apr. 26, 2001 as WO 01/29399 A1, the entire disclosure of which is hereby incorporated by reference.

The invention claimed is:

1. A fuel delivery injector for an internal combustion engine, the fuel delivery injector comprising a first portion and a second portion adapted to be connected together, the first portion having a delivery port defined between a valve seat and a valve member movable with respect to the valve seat for opening and closing the delivery port, the first portion being adapted for connection to the engine such that the delivery injector is operable to directly deliver fuel into a combustion chamber of the engine, the first portion further having a valve assembly contained therein, the valve assembly comprising the valve member and an actuating member operatively connected to the valve member, the valve member being located at one end of a valve stem, the actuating member being attached to the end of the valve stem intermediate the valve member and a terminal portion provided on the first portion at the end thereof opposite the delivery port, the second portion having an actuating means, whereby when the first and second portions are connected together the actuating means is operably associated with the actuating member to provide an actuating assembly and a flow path through the injector along which a fuel charge can be delivered to the combustion chamber.

2. A fuel delivery injector according to claim 1 wherein the fuel flow path comprises a first flow path section in the first portion and a second flow path section in the second portion, the two flow path sections communicating to provide the fuel flow path when the first and second portions are connected together.

3. A fuel delivery injector according to claim 1 wherein the engine is a spark-ignition internal combustion engine.

4. A fuel delivery injector according to claim 1 wherein the actuating assembly comprises an electromagnetic means, wherein the actuating member comprises a solenoid armature and the actuating means comprises a solenoid coil, whereby connection of the first and second portions together completes assembly of the electromagnetic means.

5. A fuel delivery injector according to claim 4 wherein the solenoid coil is disposed concentrically about the solenoid armature when the first and second portions are connected together.

6. A fuel delivery injector according to claim 1 wherein the valve stem is of hollow construction to provide a central bore which forms part of the first flow path section, at least one opening being provided in the wall of the valve stem to permit a fuel charge to pass from the central bore to an outer region from where it can be delivered into the combustion chamber upon opening of the delivery port.

7. A fuel delivery injector according to claim 1, wherein the valve assembly further comprise a valve housing, the valve stem being guided for axial movement in the valve housing as it moves the valve member into and out of engagement with the valve seat.

8. A fuel delivery injector according to claim 7 wherein the valve housing is accommodated in an insulator.

9. A fuel delivery injector according to claim 8 wherein the insulator comprises a ceramic insulator.

10. A fuel delivery injector according to claim 8 wherein the insulator is supported in a shell which incorporates a connection means for connecting the first portion to the engine.

11. A fuel delivery injector according to claim 10 wherein the shell is constructed of electrically conductive material.

12. A fuel delivery injector according to claim 10 wherein the connection means comprises a male boss portion for engaging a bore provided in the cylinder head of the engine.

13. A fuel delivery injector according to claim 12 wherein the boss portion is adapted to threadingly engage the bore in the engine cylinder head.

14. A fuel delivery injector according to claim 13 wherein the shell incorporates a portion defining a nut by means of which the first portion can be rotated into and out of threaded engagement with the bore.

15. A fuel delivery injector according to claim 12 wherein a resiliently flexible seal is provided on the insulator at a location adjacent the shell to establish a sealing connection between the first and second portions.

16. A fuel delivery injector according to claim 7 wherein a pole-piece is located on one end of the valve housing adjacent the end thereof opposite to the valve seat.

17. A fuel delivery injector according to claim 16 wherein the pole-piece comprises a ferromagnetic body having a central bore in which the valve stem is slidably received.

18. A fuel delivery injector according to claim 16 wherein the pole-piece is disposed between the armature and the insulator, with a working gap of the electromagnetic means existing between the pole-piece and the armature to accommodate limited axial movement of the valve stem for moving the valve member into and out of sealing engagement with the valve seat.

19. A fuel delivery injector according to claim 18 wherein the valve control spring is accommodated in a cavity defined between the pole-piece and the armature, with the spring acting between the pole-piece and the armature to bias the valve stem through the armature into engagement with the valve seat.

20. A fuel delivery injector according to claim 4 wherein a shroud is disposed about the solenoid armature for guidingly supporting the solenoid armature upon movement thereof as the valve member moves with respect to the valve seat.

21. A fuel delivery injector according claim 20 wherein a terminal portion is provided on the first portion at the end thereof opposite the delivery port.

22. A fuel delivery injector according to claim 21 wherein a pole-piece is be located on one end of the valve housing adjacent the end thereof opposite to the valve seat and wherein the terminal portion is separated from the armature and is fixed to the pole-piece by way of the shroud about the armature such that the armature is accommodated within the confines of the shroud.

23. A fuel delivery injector according to claim 4 wherein the electromagnetic means establishes a magnetic circuit which is completed when the first and second portions are connected together.

24. A fuel delivery injector according to claim 2 wherein the second portion comprises a cap structure which fits onto the first portion and in which the actuating means is accommodated.

25. A fuel delivery injector according to claim 24 wherein the cap structure defines a housing having a cavity with an open end through which the first portion is received.

26. A fuel delivery injector according to claim 25 wherein the second portion includes a delivery tube having a central bore defining part of the second flow path section.

27. A fuel delivery injector according to claim 26 wherein the delivery tube includes a female connector adapted to sealingly receive the male connector defined by the terminal portion on the first portion, the other end of the delivery tube defining a connector adapted for sealing connection with a fuel supply.

28. A fuel delivery injector according to claim 26 wherein a section of the delivery tube is encased in an insulating body.

29. A fuel delivery injector according to claim 28 wherein a further section of the delivery tube is surrounded by a core magnetic tube extending beyond one end of the delivery tube to define part of the cavity within the housing.

30. A fuel delivery injector according to claim 29 wherein the core magnetic tube is surrounded by an electrically insulating sleeve.

31. A fuel delivery injector according to claim 30 wherein the insulating body and the insulating sleeve are formed as a single element.

32. A fuel delivery injector according to claim 4 wherein the solenoid coil is adapted for connection to a solenoid control circuit by an electrical supply line extending between the solenoid coil and a low tension terminal provided on the second portion.

33. A fuel delivery injector according to claim 32 wherein the second portion comprises a cap structure which fits onto the first portion and in which the actuating means is accommodated, the cap structure defining a housing having a cavity with an open end through which the first portion is received, and the low tension terminal is provided on the housing.

34. A fuel delivery injector according to claim 1 wherein the valve member is defined by a valve of the outwardly opening type.

35. A fuel delivery injector according to claim 1 further comprising a projection extending outwardly beyond the delivery port.

36. A fuel delivery injector according to claim 1 wherein the projection is configured to influence the trajectory of a fuel spray issuing from the delivery port.

37. A fuel delivery injector according to claim 36 wherein the projection extends from or is defined by the valve member.

38. A fuel delivery injector according to claim 35 or 36 wherein the projection provides an electrode for a spark ignition means for the engine.

39. A fuel delivery injector according to claim 1 wherein the delivery injector comprises a single fluid fuel delivery injector.

40. A fuel delivery injector according to claim 1 wherein the injector comprises a dual fluid fuel delivery injector wherein both air and fuel are delivered by the injector to the engine.

41. A fuel delivery injector according to claim 1 wherein the first and second portions are adapted to be detachably connected together.

42. A combined injection and ignition device for a spark-ignition internal combustion engine, comprising a fuel delivery injector according to claim 1, wherein the first and second portions are adapted when connected together to establish a high voltage current path therebetween to form part of an ignition circuit.

43. A combined injection and ignition device according to claim 42 wherein the ignition circuit includes a primary electrode and a secondary electrode separated by a spark gap, wherein at least one of the electrodes is provided on the first portion.

44. A combined injection and ignition device according to claim 43 wherein the primary electrode is mounted on the first portion so as to be located within the combustion chamber when the first portion is connected to the engine.

45. A combined injection and ignition device according to claim 44 wherein the primary electrode is mounted on or configured as part of the valve member.

46. A combined injection and ignition device according to claim 43 wherein a projection extends outwardly beyond the delivery port and the projection provides the primary electrode.

47. A combined injection and ignition device according to claim 43 wherein the secondary electrode is mounted on the first portion.

48. A combined injection and ignition device according to claim 47 wherein the secondary electrode is provided on a connection means for connecting the first portion to the engine.

49. A combined injection and ignition device according to claim 48 wherein the connection means comprises a male boss portion for engaging a bore provided in the cylinder head of the engine and wherein the secondary electrode extends from the male boss.

50. A combined injection and ignition device according to claim 43 wherein a high tension terminal is provided on the second portion and wherein a high voltage current path exists between the high tension terminal and the primary electrode when the first and second portions are connected together.

51. A fuel delivery injector for an internal combustion engine, the fuel delivery injector comprising a first portion and a second portion adapted to be connected together, the first portion having a delivery port defined between a valve seat and a valve member movable with respect to the valve seat for opening and closing the delivery port, the first portion being adapted for connection to the engine such that the delivery injector is operable to directly deliver fuel into a combustion chamber of the engine, the first portion further having a valve assembly contained therein, the valve assembly comprising the valve member and an actuating member operatively connected to the valve member, the second portion having an actuating means, whereby when the first and second portions are connected together the actuating means is operably associated with the actuating member to provide an actuating assembly, and a fuel flow path through the injector along which a fuel charge can be delivered to the combustion chamber, the fuel flow path comprising a first flow path section in the first portion and a second flow path section in the second portion, the two flow path sections communicating to provide the fuel flow path when the first and second portions are connected together, the actuating assembly comprising an electromagnetic means, wherein the actuating member comprises a solenoid armature and the actuating means comprises a solenoid coil, whereby connection of the first and second portions together completes assembly of the electromagnetic means, wherein a shroud is disposed about the solenoid armature for guidingly supporting the solenoid armature upon movement thereof as the valve member moves with respect to the valve seat, a terminal portion is provided on the first portion at the end thereof opposite the delivery port, and a pole-piece is located on one end of the valve housing adjacent the end thereof opposite to the valve seat, the terminal portion being separated from the armature and fixed to the pole-piece by way of the shroud about the armature such that the armature is accommodated within the confines of the shroud, the terminal portion defining a male connector including a central bore forming part of the first flow path section and registering with the central bore in the valve stem across a space separating the terminal portion and the armature, whereby the shroud provides a connection between the terminal portion and the pole-piece and encloses the space between the armature and the terminal portion to thereby maintain the integrity of the first flow path section.

52. A fuel delivery injector according to claim 51 wherein the electromagnetic means establishes a magnetic circuit having lines of flux passing through the shroud.

53. A fuel delivery injector according to claim 52 wherein interaction between the shroud and the second portion defines that the magnetic circuit is split between the first and second portions along radial lines of flux.

54. A combined injection and ignition device for a spark-ignition internal combustion engine, comprising a fuel delivery injector comprising a first portion and a second portion adapted to be connected together, the first portion having a delivery port defined between a valve seat and a valve member movable with respect to the valve seat for opening and closing the delivery port, the first portion being adapted for connection to the engine such that the delivery injector is operable to directly deliver fuel into a combustion chamber of the engine, the first portion further having a valve assembly contained therein, the valve assembly comprising the valve member and an actuating member operatively connected to the valve member, the second portion having an actuating means, wherein when the first and second portions are connected together the actuating means is operably associated with the actuating member to provide an actuating assembly, and a flow path through the injector along which a fuel charge can be delivered to the combustion chamber, wherein when the first and second portions are connected together a high voltage current path is established therebetween to form part of an ignition circuit, the ignition circuit including a primary electrode and a secondary electrode separated by a spark gap, at least one of the electrodes being provided on the first portion, a high tension terminal being provided on the second portion and a high voltage current path existing between the high tension terminal and the primary electrode when the first and second portions are connected together, the first portion having a cylindrical shroud and the second portion having a core magnetic tube, and wherein the high voltage current path between the first and second portions is completed by the interaction of the core magnetic tube and the cylindrical shroud.

55. A combined injection and ignition device according to claim 54 wherein the first position has a pole-piece and wherein the high voltage current path is provided by the interaction of the core magnetic tube of the second portion and the pole-piece.

* * * * *